US006612733B2

(12) United States Patent
Schmidt et al.

(10) Patent No.: US 6,612,733 B2
(45) Date of Patent: Sep. 2, 2003

(54) AGITATOR ASSEMBLY

(75) Inventors: Uwe Schmidt, Schopfheim (DE); Dirk Stähler, Lauffenburg (DE)

(73) Assignee: Ekato Rühr- und Mischtechnik GmbH, Schopfheim (DE)

( * ) Notice: Subject to any disclaimer, the term of this patent is extended or adjusted under 35 U.S.C. 154(b) by 25 days.

(21) Appl. No.: 09/777,140

(22) Filed: Feb. 5, 2001

(65) Prior Publication Data

US 2001/0019515 A1 Sep. 6, 2001

(30) Foreign Application Priority Data

Feb. 11, 2000 (DE) ..... 100 06 253

(51) Int. Cl.[7] ..... B01F 7/20
(52) U.S. Cl. ..... 366/310; 366/329.1; 366/292
(58) Field of Search ..... 366/310, 329.1, 366/304, 194, 195, 196, 330.1, 330.3, 330.6, 330.7, 292; 222/241, 240

(56) References Cited

U.S. PATENT DOCUMENTS 1,713,886 A * 5/1929 Benzon
3,039,859 A * 6/1962 Kurz
3,248,019 A * 4/1966 Kohler
3,362,690 A * 1/1968 McSwain
3,893,811 A * 7/1975 Good et al. ..... 366/297
3,929,416 A * 12/1975 Tanaka et al. ..... 366/195
3,948,421 A * 4/1976 Marchadour ..... 222/241
4,228,934 A * 10/1980 Carr ..... 366/196
4,260,267 A 4/1981 Walton ..... 366/329.1
4,544,281 A 10/1985 Wilkinson ..... 366/330.1
4,808,005 A * 2/1989 Lewis et al. ..... 366/196
4,941,750 A 7/1990 Bouchez et al. ..... 366/330.3
5,249,861 A * 10/1993 Thomson ..... 366/194
5,339,998 A * 8/1994 Warren ..... 222/241
5,813,837 A * 9/1998 Yamamoto et al. ..... 366/330.3
5,951,162 A * 9/1999 Weetman et al. ..... 366/330.3

* cited by examiner

*Primary Examiner*—Tony G. Soohoo
(74) *Attorney, Agent, or Firm*—Henry M. Feiereisen; Ursula B. Day

(57) ABSTRACT

An agitator assembly, in particular for mixing, granulating and drying solid matter, includes a vessel; and an agitator received in the vessel and having at least one sweep blade, with the sweep blade ascending from an inner zone of the vessel to an outer zone thereof at an angle of inclination ranging from about 15° to 60° with respect to the horizontal.

31 Claims, 3 Drawing Sheets

AGITATOR ASSEMBLY

CROSS-REFERENCES TO RELATED APPLICATIONS

This application claims the priority of German Patent Application Serial No. 100 06 253.9, filed Feb. 11, 2000 the subject matter of which is incorporated herein by reference.

BACKGROUND OF THE INVENTION

The present invention relates, in general, to agitator assemblies, and more particularly to an agitator assembly of a type having one or more sweep blades mounted at a motor driven shaft and operating in an agitation vessel.

Agitator assemblies of this type are typically used for mixing, granulating and drying solid matter. In this case, it is desirable to avoid inadequate or insufficient mixing during agitation. Furthermore, if agitation is carried out for drying solid matter, agitation should not only provide proper mixing of the solid matter but, in addition, should also provide a high degree of heat transfer during the process of agitation. Thus, it is desirable that agitation performing a high degree of mixing the solid matter is provided and that also a high degree of heat transfer within the agitated material is realized.

Apart from heating or cooling solid matter, such an agitator assembly may also be useful for carrying out chemical reactions, for volatilizing solvents, and for crystallization through evaporation or cooling.

It would be desirable and advantageous to provide an improved agitator assembly for agitation of solid matter in an agitation vessel such as to provide a high degree of mixing and a high degree of internal heat transfer.

SUMMARY OF THE INVENTION

According to one aspect of the present invention, an agitator assembly is provided which includes a vessel; and an agitator received in the vessel and having at least one sweep blade, with the sweep blade ascending from an inner zone of the vessel to an outer zone thereof at an angle of inclination ranging from about 15° to 60° with respect to a horizontal.

Suitably, the inner and outer peripheral edges of the sweep blade is configured in an elliptical shape. The sweep blade may have a minimum width at its lower end and a maximum width at the upper end.

In a configuration of the agitator assembly with more than one sweep blades, at least one of the sweep blades may be provided with a bottom blade mounted at the lower end of the sweep blade and serving as a bottom clearer of the agitation vessel. The bottom blade may be attached with its upper end to the lower end of the sweep blade and is suitably so configured that its maximum width is at the upper end and its minimum width is at its lower end. Advantageously, the bottom blade may be formed in a helical shape and mounted relative to the horizontal at an angle in a range from 5° to about 55° and increasing from the lower end to the upper end.

According to another feature of the present invention, the sweep blade is provided at its upper end with a side blade, which is suitably of flat configuration and attached to the sweep blade at an angle of inclination from about 1° to about 30° relative to the vertical. The side blade may also be attached to the sweep blade at a clearance angle of about 1° to about 30° with respect to the inner wall of the agitation vessel.

The side blade may have a leading edge which is positioned at a substantially constant distance from the cylindrical inner wall of the agitation vessel, with the distance ranging approximately from 5 mm to 10 mm. Suitably, the leading edge of the side blade has an elliptical shape.

According to a further feature of the present invention, a baffle may be arranged above the sweep blade, with the baffle having a lower edge extending relative to the horizontal at an angle from about 15° to 60°. The baffle is suitably oriented relative at an angle from about 0° to about 75° to a radial line which extends through a center axis of the baffle and through a center axis of a driveshaft by which the agitator is driven. Suitably, the driveshaft is installed in overhead configuration so that no bearings or seals are required in the product zone.

According to a further feature of the present invention, at least one motor-driven crusher may be mounted above the sweep blade, with the crusher having one end carrying a plurality of knives. The circumferential speed of the crusher is suitably in the range of about 15 m/sec.

According to a further feature of the present invention, the agitation vessel is configured with an upper cylindrical portion and a lower conical bottom portion connected to the upper portion and having a cone angle in the range of about 60° to about 120°, preferably a cone angle of 90°. Suitably, the sweep blades are disposed in the conical bottom portion of the agitation vessel. The upper cylindrical portion and the lower bottom portion have heights at a ratio of about 1:1 to about 2:1.

With the agitator assembly according to the invention, a complete circulation of product material is realized, resulting in a high degree of product mixing. A high degree of product mixing provides a high rate of heat transfer and an even temperature level among the product, thus leading to an extensive product surface regeneration and accomplishing good discharge of the product without leaving recondensation on the cooler product. In turn, the high heat transfer surface leads to shorter drying and cooling sessions. In conjunction with the baffles and the crushers, the sweep blades of the agitator assembly according to the present invention, bring about a good coarse comminution and a rapid and easier break up of clumps and lumps.

An agitator assembly according to the present invention is thus capable to also disperse agglomerates or to produce granulates, and to agitate doughy or waxy masses. It is therefore not only suitable for flowable products but also for use with those materials that have a doughy consistency and with those that form clumps at drying, as oftentimes encountered in the pharmaceutical industry.

BRIEF DESCRIPTION OF THE DRAWING

The above and other objects, features and advantages of the present invention will be more readily apparent upon reading the following description of preferred exemplified embodiments of the invention with reference to the accompanying drawing, in which.

DETAILED DESCRIPTION OF PREFERRED EMBODIMENTS

Figure 1:
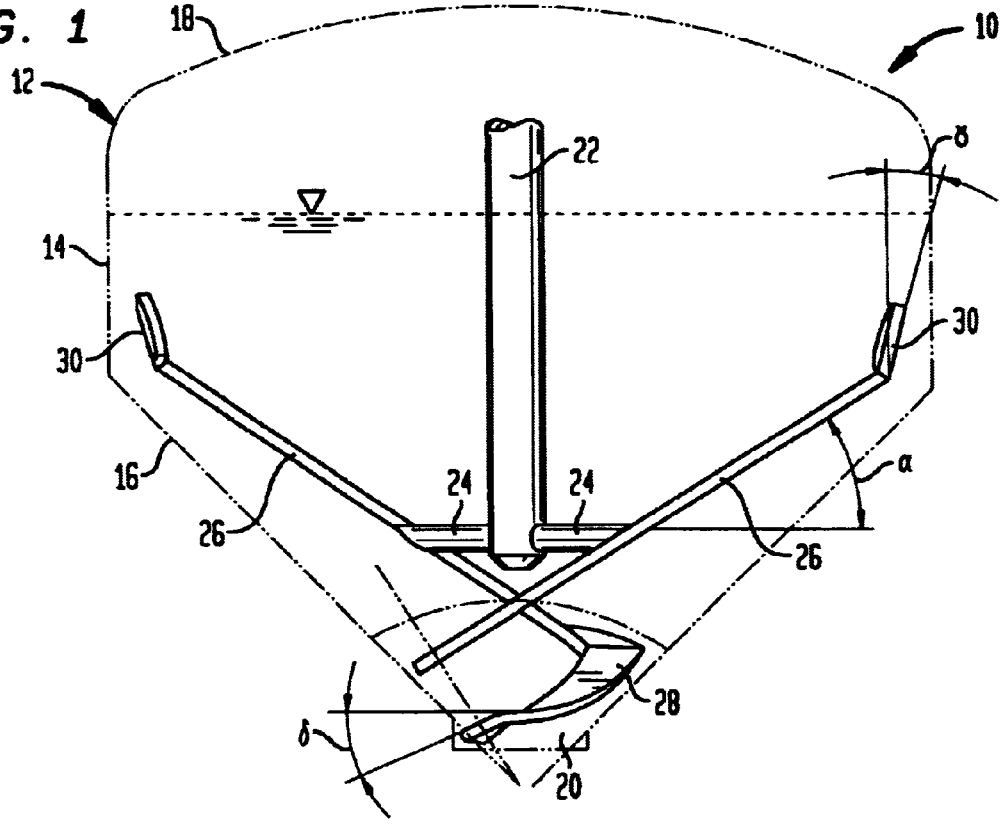
FIG. 1 is a simplified schematic view of one embodiment of an agitator assembly according to the present invention.

Throughout all the Figures, same or corresponding elements are generally indicated by same reference numerals.

Turning now to the drawing, and in particular to FIG. 1, there is shown a simplified, schematic view of an agitator assembly according to the present invention, generally designated by reference numeral 10 and including an agitation vessel 12 whose outline is shown here only by way of a dash-dot line. The agitation vessel 12 has an upper open-topped cylindrical portion 14 and a conical lower portion 16 which is connected to the upper cylindrical portion 12 and has a cone angle in the range of about 60° to about 120°, preferably about 90°.

The open top of the upper portion 14 of the agitation vessel 12 can be closed by an arched lid 18, and the lower portion 16 has with an outlet 20.

Figure 2:
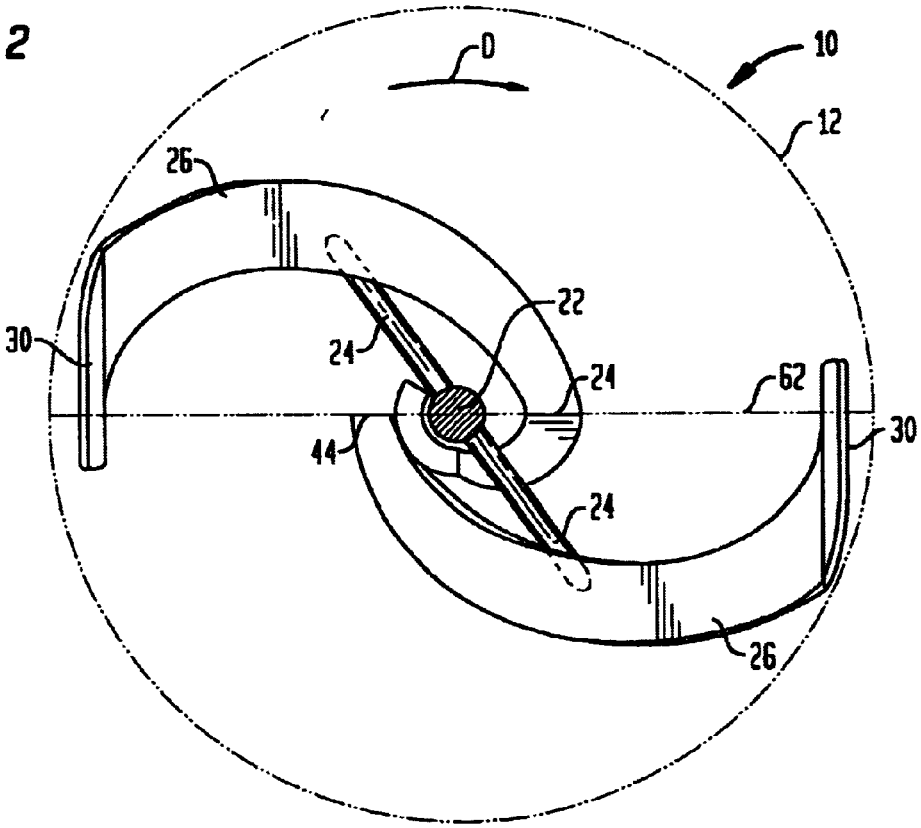
FIG. 2 is a top view of the agitator assembly shown in FIG. 1.

A driveshaft 22 extends from above through the lid 18 into the interior of agitator vessel 12 for attachment of an agitator and rotation of the agitator in a rotation direction, as indicated in FIG. 2 by arrow D. The driveshaft 22 has a lower end which carries two struts 24 in opposite disposition for attachment to two sweep blades 26 which form part of the agitator and are thus located substantially in the lower portion 16 of the agitation vessel 12. Persons skilled in the art will understand that the arrangement of two sweep blades is done by way of example only, Of course, the agitator may certainly have more or less than two such sweep blades and agitators of such configuration should also be considered within the scope of the present invention.

As shown in FIG. 1, the sweep blades 26 are arranged in slanting disposition within the agitation vessel 12 such as to extend from a lower inner zone to an outer upper zone relative to the horizontal at an angle $\alpha$ ranging from about 15° to about 60°.

In the following description, the term "horizontal" will denote any direction that is perpendicular to a center axis of the driveshaft 22, while the term "vertical" will denote the same direction as the center axis of the driveshaft 22.

At least one of the sweep blades 26 (here the sweep blade 26 on the left side of FIG. 1) is provided with a bottom blade 28 that is designed for use as a bottom clearer. The bottom blade 28 has an upper end 48, which is securely mounted to a lower end 44 of the sweep blade 26 (cf. FIG. 3), and a lower end 50 which extends into the outlet 20. The bottom blade 28 is twisted into a helical shape and is disposed downwards relative to the rotation plane and the horizontal at an angle $\delta$ which ascends from top to bottom and ranges from about 5° to about 50°.

Each sweep blade 26 is defined by an inner peripheral edge 40 and an outer peripheral edge 42, whereby the geometry of the sweep blades 26 is generated by an oblique cut through a cone so that the inner peripheral edge 40 and the outer peripheral edge 42 of the sweep blade 30 have an elliptic configuration whereas the sweep blades 26 remain flat. The width of the sweep blades 26 increases from a minimum width at the lower end 44 to a maximum width at the upper end 46 of the sweep blades 26. On the other hand, the width of the bottom blade 28 decreases from top to bottom such that a maximum width is at the upper end 48 and a minimum width is at the lower end 50.

A side blade 30 is securely fixed to the upper, outer end 46 of each of the sweep blades 26. The side blade 30 is flat and its geometry is generated by an oblique cut through a cylinder, whereby the leading edge or leading rim 52 of the side blade 30 has an elliptic configuration. The side blades 30 are mounted to the sweep blades 26 at an angle $\gamma$ of about 1° to about 30° relative to the vertical.

Figure 4:
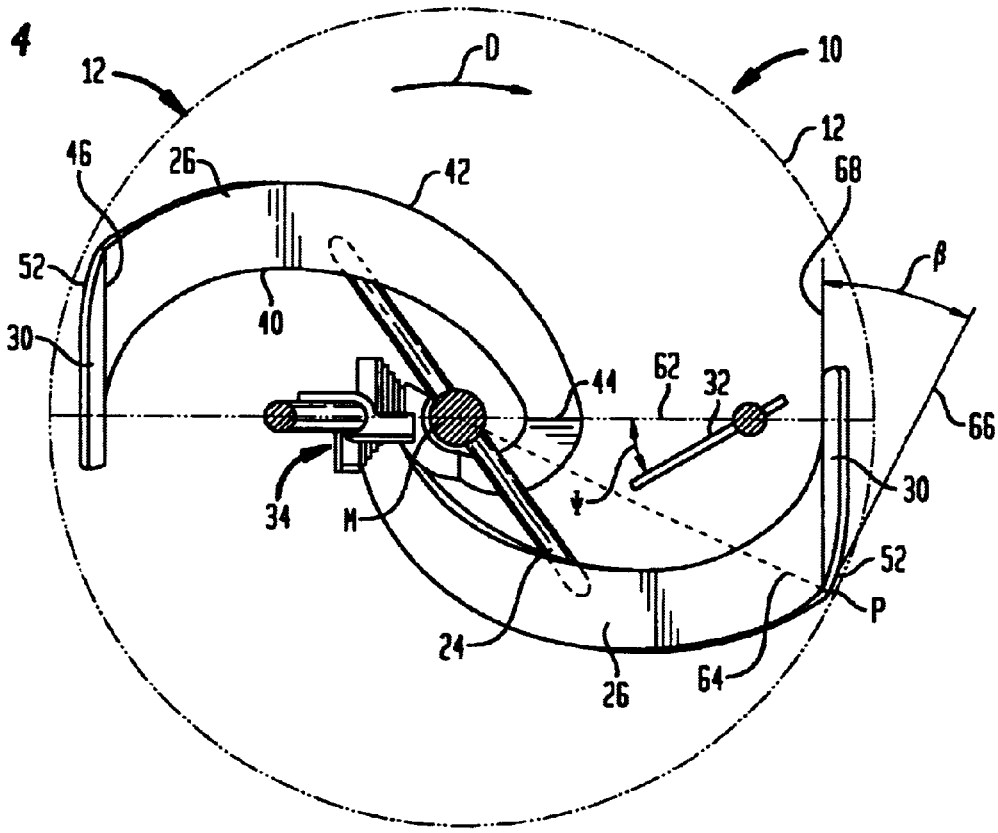
FIG. 4 is a top view of the agitator assembly shown in FIG. 3.

As shown in FIG. 4, the side blades 30 are oriented relative to the side wall of the agitation vessel 12 with a clearance angle $\beta$ ranging from about 1° to about 30°. The clearance angle $\beta$ is determined as follows: A line 64 is drawn between the center point M of the driveshaft 22 and the intersection point P between the side blade 30 and the sweep blade 26. A vertical 66 upon the line 64 at intersection point P represents the reference line for angle $\beta$ which is defined between the vertical 66 and the intersection line 68 between the sweep blade 26 and side blade 30, wherein the intersection point P designates the leading end of the intersection line 68 in rotation direction D of the agitator assembly.

Figure 6:
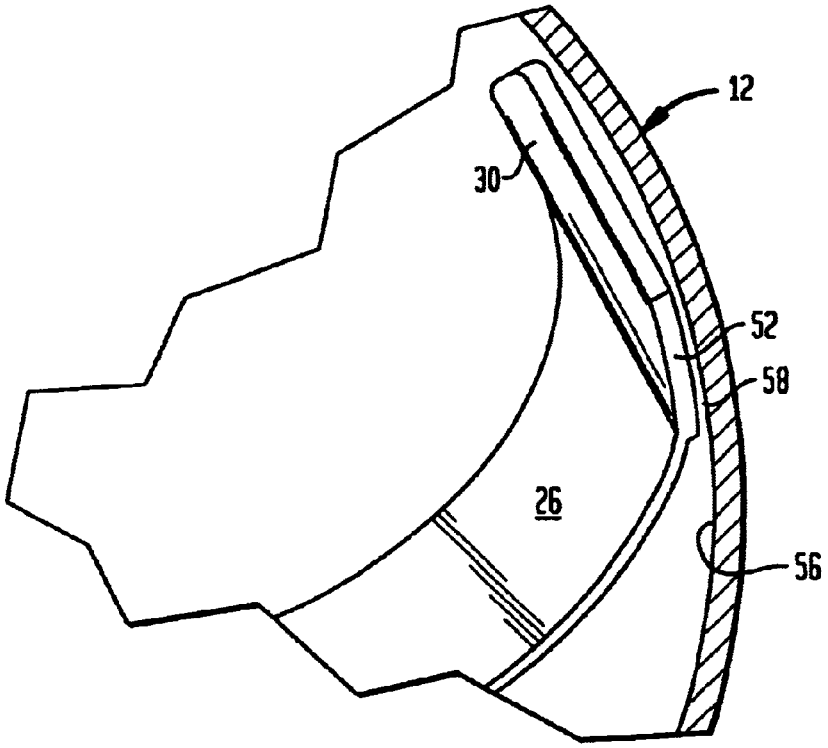
FIG. 6 is a cutaway view of a sweep blade provided with a side blade for use in an agitator assembly according to the present invention.

As shown in particular in FIG. 6, the leading edge 52 of each of the side blades 30 is spaced from the cylindrical inner wall 56 of the agitator vessel 12 at a substantially constant distance of about 5 mm to 10 mm.

Figure 3:
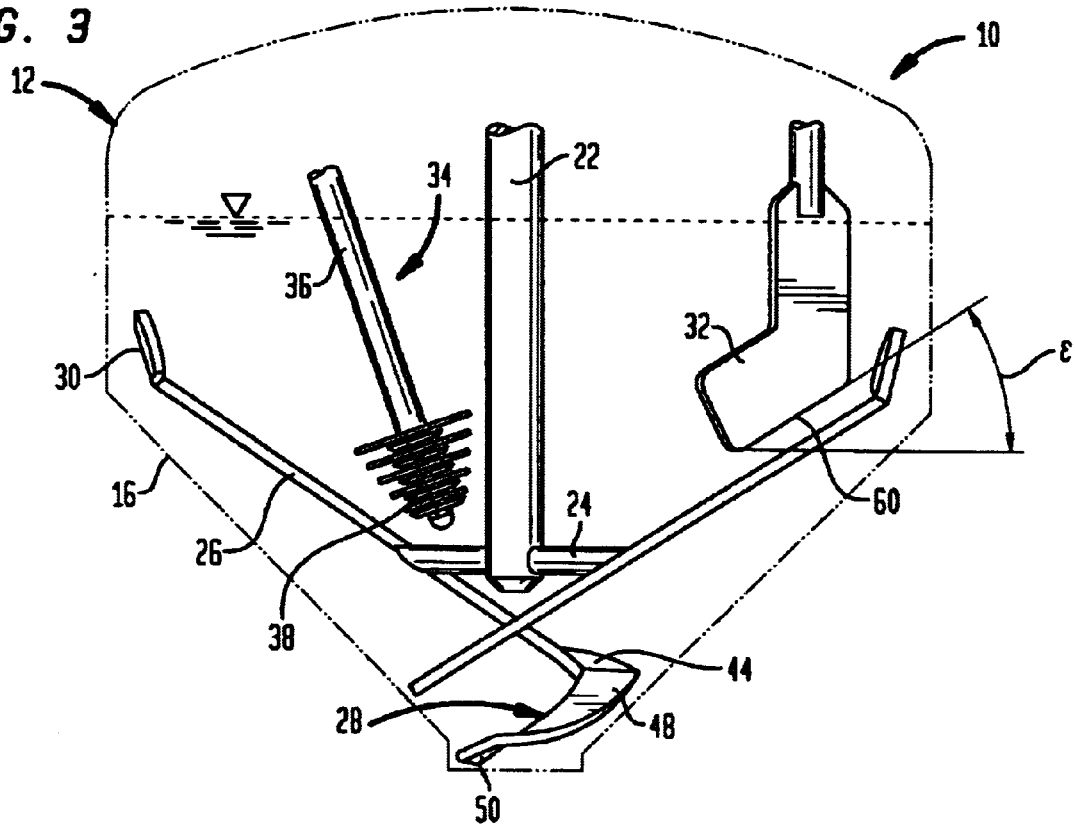
FIG. 3 is a simplified schematic view of another embodiment of an agitator assembly according to the present invention.

FIGS. 3 and 4 show a modification of an agitator assembly according to the present invention which is provided with auxiliary devices, for example a baffle 32 and/or a crusher 34 which are mounted from above into the agitation vessel 12. Although FIGS. 3 and 4 show the installation of both, baffle 32 and crusher 34 in the agitation vessel 12, persons skilled in the art will understand that this is done by way of example only, as the agitation assembly 10 may be configured also in such a manner as to include only one of these components.

The baffle 32 may be formed as a flat plate of substantially V-shaped configuration and is installed into the agitation vessel 12 from above, whereby a lower edge 60 of the baffle 32 defines relative to the horizontal an angle $\epsilon$ of about 15° to about 60°, and extends from an inner lower zone to an upper outer zone of the vessel 12. As shown in FIG. 4, the baffle 32 is disposed in the rotation direction D at an angle $\psi$ of about 0° to about 75° relative to a radial line 62, whereby the radial line 62 runs through the center axis of the driveshaft 22 and through the center axis of the baffle 32.

As shown in FIG. 3, the crusher 34 is inserted likewise from above through the lid 18 into the agitation vessel 12 and dips in the agitation product in a same way as the baffle 32. The crusher 34 includes a motor-driven shaft 36 having a lower end which carries a plurality of knives or similar cutting tools for comminuting possible clumps in the agitation product. The drive (not shown here) for the crusher 34 is mounted onto the lid 18, with the shaft 36 extending eccentrically between the shaft 22 and the sweep blades 26.

The circumferential speed of the crusher 34 is preferably above 15 m/sec so that locally high shear forces can be introduced into the product, particularly heavy clumps and lumps within the agitation product can be comminuted. As described above, the cutting knives 34 may be replaced by other tools to apply more or less of shear forces in the product depending on the product properties.

The baffle 32 reduces the rotational motion in the agitation product and is capable to move larger clumps that may have been formed during drying of the product, in the direction of the sweep blades 26 for subsequent comminution.

Figure 5:
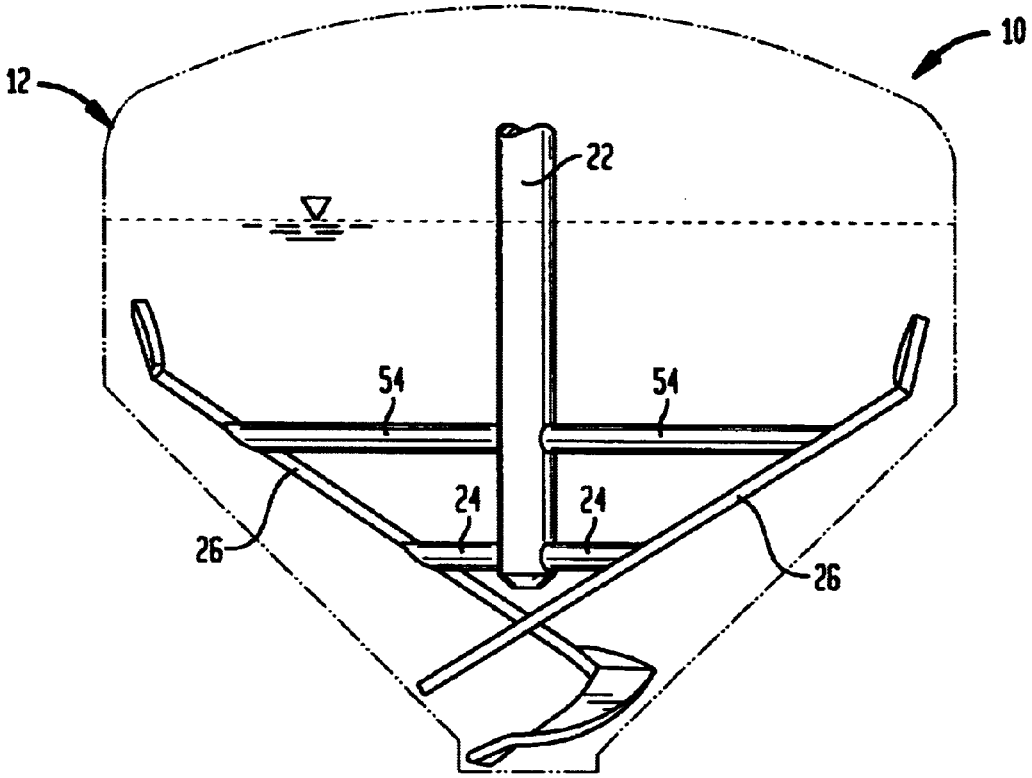
FIG. 5 is a schematic view of yet another embodiment of an agitator assembly according to the present invention.

As shown in FIGS. 1 and 3, the struts 24 mounted at the lower end of the shaft 22 are disposed in the lower half of the conical bottom portion 16 of the agitation vessel 12, thereby leaving as much space as possible for mounting auxiliary devices such as the baffle 32 or the crusher 34. If desired, an additional pair of struts 54 for attachment of further sweeping blades 26, as shown in FIG. 5, may be mounted to the driveshaft 22 above the first pair of struts 24.

The agitator assembly according to the present invention operates as follows:

When rotating the sweep blades 26 in rotation direction D, the product is first transported along the wall of the agitation vessel 12 along a slanted path and then axially upwards and ultimately by the side blades 30 in the region of the surface level of the product towards the center of the agitation vessel 12. In the center region, the product is being drawn downwards as a consequence of the mass flow, thereby generating a spatially expansive mixing motion that leaves the agitated material essentially free of dead space, and thus ensures short mixing periods and high heat transfer. The circumferential speed of the driveshaft 22 is high enough so that easily disintegrateable clumps and lumps can be broken up by the shearing forces generated by sweep blades 26. Clumps that are more difficult to break up can be disintegrated by one or more baffles 32, while clumps that are difficult to break up can be crushed by employing the eccentric crusher 34 mounted from above.

By means of the bottom blade 28 which is configured as a bottom clearer, a product mixture that is free of dead space is realized in the lower region of the conical bottom portion 16 and above the outlet valve (not shown here). The afore-described downwardly increasing angle δ of the bottom blade 28 maintains throughout the product a good mixing action which, if that angle were constant, would deteriorate, as the circumferential speed at the bottom blade 28 would progressively decrease toward the outlet valve. The increasing angle δ compensates this effect and realizes a product mixture free of dead space throughout the entire agitation vessel 12.

The afore-described close proximity of the side blades 30 to the inner wall of the agitation vessel 12 avoids, at least substantially, wall deposits and crust formation and ensures good heat transfer coefficients.

Because of the cantilevered mount of shaft 22 which projects into the agitation bearings or gaskets need not be mounted within the area of the agitation material.

While the invention has been illustrated and described as embodied in an agitation assembly, it is not intended to be limited to the details shown since various modifications and structural changes may be made without departing in any way from the spirit of the present invention.

What is claimed as new and desired to be protected by Letters Patent is set forth in the appended claims:

1. An agitator assembly, comprising a vessel; and an agitator received in the vessel and having at least one sweep blade, said sweep blade ascending from an inner zone of the vessel to an outer zone thereof at an angle of inclination ranging from about 15° to 60° with respect to a horizontal, wherein the sweep blade has inner and outer ends, said sweep blade defined by a width which is at a minimum at the inner end and at a maximum at the outer end.

2. The agitator assembly of claim 1, wherein the agitator has at least two of said sweep blade.

3. The agitator assembly of claim 1, wherein the sweep blade has a flat configuration.

4. The agitator assembly of claim 1, wherein the sweep blade has an inner peripheral side and an outer peripheral side, said inner and outer peripheral sides having an elliptic configuration.

5. The agitator assembly of claim 1, wherein the agitator has a side blade secured to an upper outer end of the sweep blade, said side blade extending at an angle of inclination of about 1° to about 30° with respect to a vertical.

6. The agitator assembly of claim 5, wherein the side blade is positioned relative to a wall of the vessel at a clearance angle of about 1° to about 30°.

7. The agitator assembly of claim 5, wherein a leading edge of the side blade has a substantially constant distance from a wall of the vessel.

8. The agitator assembly of claim 7, wherein the distance is about 5 mm to 10 mm.

9. The agitator assembly of claim 7, wherein the leading edge of the side blade has an elliptic shape.

10. The agitator assembly of claim 1, further comprising at least one baffle disposed above the sweep blade, said baffle having a lower edge extending at an angle of about 15° to about 60° with respect to the horizontal.

11. The agitator assembly of claim 10, wherein the baffle is flat.

12. The agitator assembly of claim 10, and further comprising a driveshaft for rotating the agitator in an operating direction, said driveshaft defined by a center axis and said baffle defined by a center axis, wherein the baffle is oriented in the operating direction at an angle of about 0° to 75° relative to a radial line which extends through the center axis of the driveshaft and the center axis of the baffle.

13. The agitator assembly of claim 1, and further comprising at least one motor-driven crusher mounted above the sweep blade and having one end carrying a plurality of knives.

14. The agitator assembly of claim 13, wherein the crusher is configured for a circumferential speed of greater than 15 in/sec.

15. The agitator assembly of claim 1, wherein the vessel has an upper cylindrical portion and a lower conical bottom portion connected to the upper portion.

16. The agitator assembly of claim 15, wherein the conical bottom portion is defined by a cone angle of about 60° to about 120°.

17. The agitator assembly of claim 16, wherein the cone angles is 90°.

18. The agitator assembly of claim 15, wherein the bottom portion has a height and the upper cylindrical portion has a height, wherein a ration of the height of the cylindrical section to the height of the bottom section ranges from 1:1 to 2:1.

19. The agitator assembly of claim 15, wherein the sweep blade are positioned substantially within the conical bottom portion of the vessel.

20. The agitator assembly of claim 1, wherein the agitator is configured for mixing, granulating and drying solids.

21. An agitator assembly, comprising agitating means for mixing, granulating and drying solids in a vessel, said agitating means having at least two sweep blades arranged in substantial opposite relationship and so received in the vessel as to ascend at an angle of inclination ranging from about 15° to 60° with respect to a horizontal, wherein the agitating means includes a bottom blade intended for clearing a bottom of the vessel, and wherein at least one of the sweep blades configured for attachment of said bottom blade to a lower end of the at least one sweep blade.

22. An agitator assembly, comprising a vessel; and an agitator received in the vessel and having at least one sweep blade, said sweep blade ascending from an inner zone of the vessel to an outer zone thereof at an angle of inclination ranging from about 15° to 60° with respect to a horizontal, and further comprising a bottom blade intended for clearing a bottom of the vessel, said bottom blade connected to the at least one sweep blade to a lower end thereof.

23. The agitator assembly of claim 22, wherein the bottom blade has upper and lower ends, said bottom blade defined by a width which is at a minimum at the lower end and at a maximum at the upper end.

24. The agitator assembly of claim 23, wherein the bottom blade descends at an inclination with respect to the horizontal at an angle which increases from the upper end to the lower end and ranges from about 5° to about 55°.

25. The agitator assembly of claim 22, wherein the bottom blade has a helical shape.

26. The agitator assembly of claim 22, wherein the agitator has a side blade secured to an upper outer end of the sweep blade, said side blade extending at an angle of inclination of about 1° to about 30° with respect to a vertical.

27. The agitator assembly of claim 22, wherein the agitator has at least two of said sweep blade.

28. The agitator assembly of claim 22, wherein the sweep blade has a flat configuration.

29. The agitator assembly of claim 22, wherein the sweep blade has an inner peripheral side and an outer peripheral side, said inner and outer peripheral sides having an elliptic configuration.

30. An agitator assembly, comprising a vessel; and an agitator received in the vessel and having at least one sweep blade, said sweep blade ascending from an inner zone of the vessel to an outer zone thereof at an angle of inclination ranging from about 15° to 60° with respect to a horizontal and further comprising at least one motor-driven crusher mounted above the sweep blade and having one end carrying a plurality of knives, wherein the crusher is configured for a circumferential speed of greater than 15 m/sec.

31. An agitator assembly, comprising:

a vessel; and an agitator received in the vessel and having at least one sweep blade, said sweep blade ascending from an inner zone of the vessel to an outer zone thereof at an angle of inclination ranging from about 15° to 60° with respect to a horizontal, and a bottom blade intended for clearing a bottom of the vessel, the at least one sweep blade configured for attachment of said bottom blade to a lower end of the at least one sweep blade, and wherein the agitator has a side blade secured to an upper outer end of the sweep blade.

* * * * *

UNITED STATES PATENT AND TRADEMARK OFFICE

CERTIFICATE OF CORRECTION

PATENT NO. : 6,612,733 B2
DATED : September 2, 2003
INVENTOR(S) : Uwe Schmidt and Dirk Stähler It is certified that error appears in the above-identified patent and that said Letters Patent is hereby corrected as shown below:

Column 6,
Line 34, delete ".. 15 in/sec" and insert -- 15 m/sec --.

Signed and Sealed this

Third Day of February, 2004

JON W. DUDAS
*Acting Director of the United States Patent and Trademark Office*